US008633646B2

(12) United States Patent
Molezion

(10) Patent No.: US 8,633,646 B2
(45) Date of Patent: Jan. 21, 2014

(54) METHOD AND APPARATUS FOR RADIO-FREQUENCY CONTROLLABLE LED LAMP FIXTURE ANTENNA

(75) Inventor: Danny J. Molezion, Alpharetta, GA (US)

(73) Assignee: Freescale Semiconductor, Inc., Austin, TX (US)

( * ) Notice: Subject to any disclaimer, the term of this patent is extended or adjusted under 35 U.S.C. 154(b) by 80 days.

(21) Appl. No.: 13/460,226

(22) Filed: Apr. 30, 2012

(65) Prior Publication Data

US 2013/0285544 A1 Oct. 31, 2013

(51) Int. Cl.
*H05B 37/02* (2006.01)
*H01J 13/46* (2006.01)

(52) U.S. Cl.
USPC ..... 315/34; 315/35; 315/307

(58) Field of Classification Search
USPC ..... 315/33–35, 291, 307–309
See application file for complete search history.

(56) References Cited

U.S. PATENT DOCUMENTS

| | | | | |
|---|---|---|---|---|
| 7,756,556 | B2 | 7/2010 | Patel et al. | |
| 2012/0274208 | A1 * | 11/2012 | Chen et al. | 315/34 |
| 2013/0193847 | A1 * | 8/2013 | Recker et al. | 315/86 |

* cited by examiner

*Primary Examiner* — Don Le
(74) *Attorney, Agent, or Firm* — Jonathan N. Geld

(57) ABSTRACT

An apparatus and system for incorporating an unshielded antenna into an LED fixture are provided, such that the LED fixture can be individually controlled through RF signals, such as those propagated by a home automation system or other RF-based lighting control systems. An LED fixture is provided that includes an antenna that is coupled to an electronic control board of the LED fixture and extends to a region external to the heat sink of the LED fixture. By extending the antenna in this manner, RF signals can be received and transmitted by the control board of the LED fixture with significantly reduced attenuation. In one embodiment, the antenna is routed from the control board to an optical assembly support frame for the LED fixture. The optical assembly support frame can either provide a structure along which to guide the antenna or can comprise the antenna itself.

15 Claims, 4 Drawing Sheets

- PRIOR ART -

- PRIOR ART -

METHOD AND APPARATUS FOR RADIO-FREQUENCY CONTROLLABLE LED LAMP FIXTURE ANTENNA

BACKGROUND

1. Field

This disclosure relates generally to radio frequency control of LED lamp fixture, and more specifically, to an LED lamp fixture having a transceiver with a dipole antenna configured to extend beyond portions of the LED fixture that can shield radio frequency communication.

2. Related Art

Energy conservation efforts have led to development of alternatives to historically used incandescent light bulbs, such as compact fluorescent and LED-based fixtures. LED fixtures, in particular, are an increasingly serious replacement candidate for incandescent bulbs, owing to relatively long life, low power consumption, brightness, and versatility. Since LED fixtures are controlled electronically, there is opportunity for direct control of LED fixture characteristics, such as on/off, dimming, and color control.

Home automation and other lighting control systems use radio frequency (RF) communication to propagate control signals to devices controlled by the system. But typical construction of LED fixtures provides for heat sinks and other metallic components that act as RF shielding around the control board of the LED fixture, thereby impacting the ability to directly use RF control for such fixtures. The shielding reduces the ability of RF signals to get to an antenna located on the control board (e.g., an inverted F antenna). It is therefore desirable to have an LED fixture that can be controlled by RF signals without having diminished RF receiving capability.

BRIEF DESCRIPTION OF THE DRAWINGS

The present invention may be better understood, and its numerous objects, features, and advantages made apparent to those skilled in the art by referencing the accompanying drawings.

The use of the same reference symbols in different drawings indicates identical items unless otherwise noted. The figures are not necessarily drawn to scale.

DETAILED DESCRIPTION

Embodiments of the present invention provide a method and apparatus for incorporating an unshielded antenna into an LED fixture, such that the LED fixture can be individually controlled through RF signals, such as those propagated by a home automation system or other RF-based lighting control systems. An LED fixture is provided that includes an antenna that is coupled to an electronic control board of the LED fixture and extends to a region external to the heat sink of the LED fixture. By extending the antenna in this manner, RF signals can be received and transmitted by the control board of the LED fixture with significantly reduced attenuation. In one embodiment, the antenna is routed from the control board to an optical assembly support frame for the LED fixture. The optical assembly support frame can either provide a structure along which to guide the antenna or can comprise the antenna itself. In embodiments of the present invention, the antenna is an odd-multiple half-wavelength dipole antenna.

LED light fixtures have become a reasonable alternative for applications previously incorporating incandescent light bulbs. LED fixtures offer an ability to control light intensity (e.g., warmth and dimming), light color, and are available in a variety of sizes. This flexibility suggests a desirability to incorporate LED fixtures in a premises automation environment in which each fixture could be individually controlled as appropriate to the environment and purpose.

Premises automation systems typically use radio frequency (RF) signals to control devices allocated to the automation system. These RF signals can conform to one or more of a variety of protocols, such as Zigbee, Z-wave, Bluetooth, and the like. These RF protocols typically use transmission frequencies of 900 MHz, 2.4 GHz, or 5.8 GHz.

One issue with incorporating LED fixtures in such a premises automation system is providing the RF signals to the control board of a typical LED fixture. LED fixtures require a substantial heat sink in order to allow the LEDs to function efficiently and over a long period of time. The heat sink and other metallic portions of the LED fixture have a consequential effect of shielding the LED's control board, where an antenna typically will be located, from external RF signals. Since LED fixtures should conform to size limitations presented by incandescent bulbs previously used for an application, any solution to the RF antenna issue should also conform to those size limitations.

Figure 1:
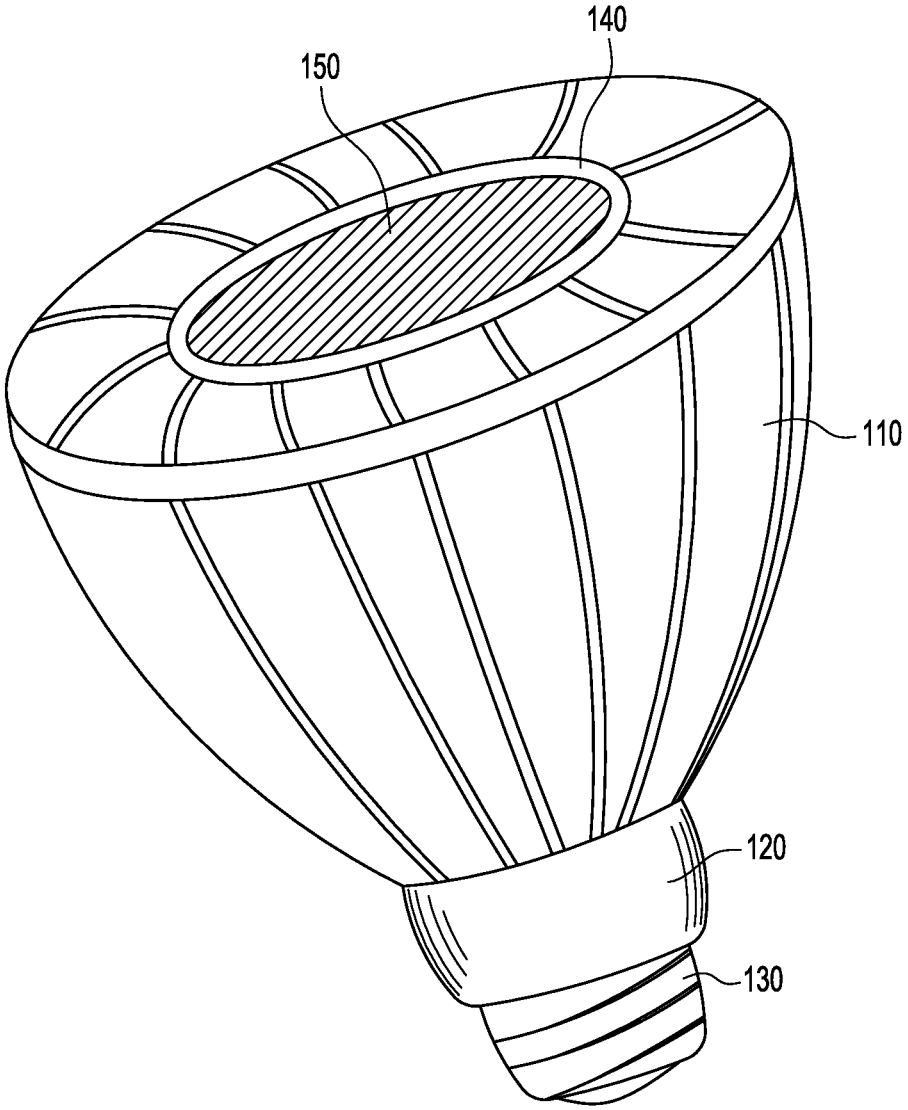
FIG. 1 is a simplified diagram illustrating one example of a typical LED lighting fixture.

FIG. 1 is a simplified diagram illustrating one example of a prior art LED fixture, which is an example of a LED fixture designed to replace incandescent flood light bulbs. A prominent external feature of LED fixture 100 is a heat sink 110. Heat sink 110 is typically constructed of heat-conducting metals such as aluminum, copper, or a metal alloy, selected in accord with the planned application. The purpose of the heat sink is to reduce the operating temperature of the LED itself, thereby increasing the lifetime of the LED and improving thermal efficiency of the LED. Heat sinks can be designed in a variety of shapes appropriate to a desired application and include structures such as fins to enhance thermal dissipation.

LED fixture 100 further includes a housing section 120 in which the control board for the LED fixture can be located, and a socket base 130 that conforms to the size and type of electrical socket used for the planned application. LED fixture 100 further includes a cavity region 140, defined by heat sink 110, in which the LED can be mounted. An optical assembly 150 can also be placed within cavity region 140. Optical assembly 150 can include one or more lenses mounted near the face of the LED fixture, where the one or more lenses are mounted on a support frame that extends into the cavity, as will be discussed more fully below.

It should be realized that LED fixture 100, as illustrated, is provided by way of example, and that LED fixtures can take a variety of shapes and sizes as required for the specific intended application. Embodiments of the present invention are not limited to a particular size, shape or composition of LED fixture.

Figure 2:
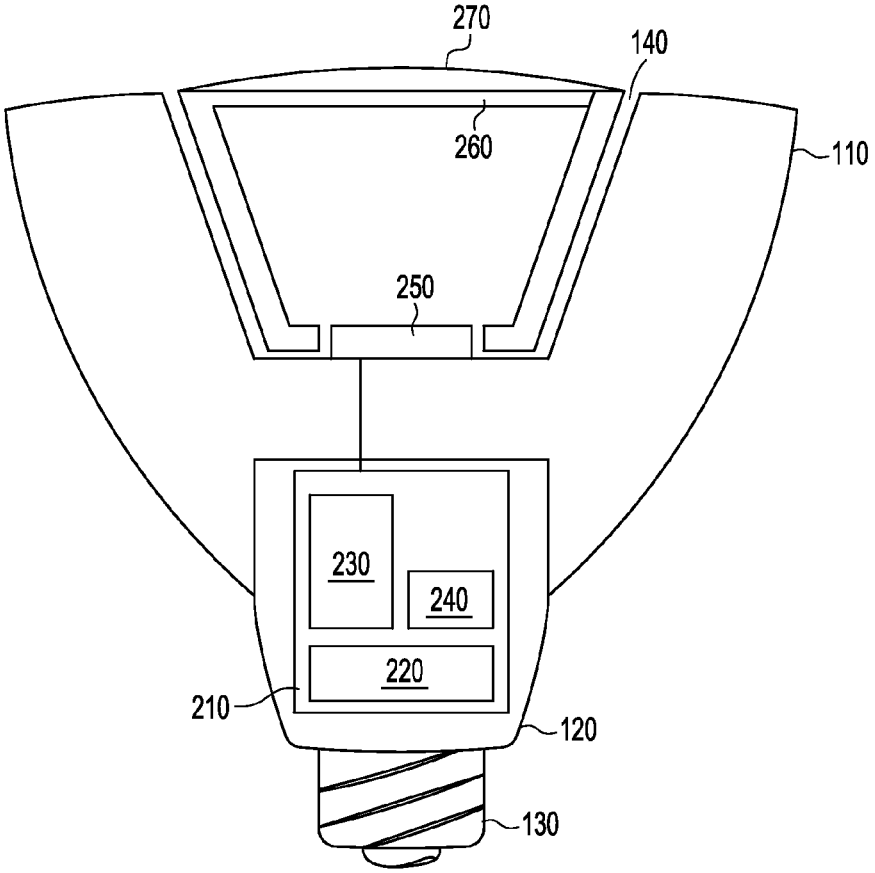
FIG. 2 is a simplified block diagram illustrating a cross-section of a typical LED fixture.

FIG. 2 is a simplified block diagram illustrating a cross-section of LED fixture 100. FIG. 2 further illustrates heat sink 110 and a shape of cavity 140 that may be found in a typical LED fixture designed for floodlight applications. As discussed above, LED fixture 100 further includes a housing 120 that includes a control board 210. Control board 210 can be a printed circuit board that includes components such as power supply 220, LED driver circuit 230, and a processor 240. Control board 210 receives operating power for both the control board and the LED from socket base 130. Processor 240 can take the form of a microcontroller unit (MCU) or other processor, and can provide application control signals to driver 230. Driver 230 provides appropriate power signals to LED 250, which is mounted within cavity 140. Power signals are provided between control board 210 and LED 250 via an appropriate signal conduit channeled through heat sink 110 to cavity 140.

As illustrated, within cavity 140 is optical assembly 150, which includes a support frame 260 and optics 270. Optics 270 can include one or more lenses used to focus the light emitted by LED 250 in a desirable manner appropriate to the application. Optics 270 are mounted on support frame 260. Support frame 260 is typically a non-conducting material, such as plastic. The fixture frame is mounted to heat sink 110 at the base of cavity 140.

As illustrated in FIG. 2, if an antenna were located on control board 210 (e.g., a printed circuit antenna such as an inverted-F antenna), the antenna would be within the shielded area of heat sink 110. Such RF shielding dramatically affects the ability of the antenna to receive signals.

Figure 3:
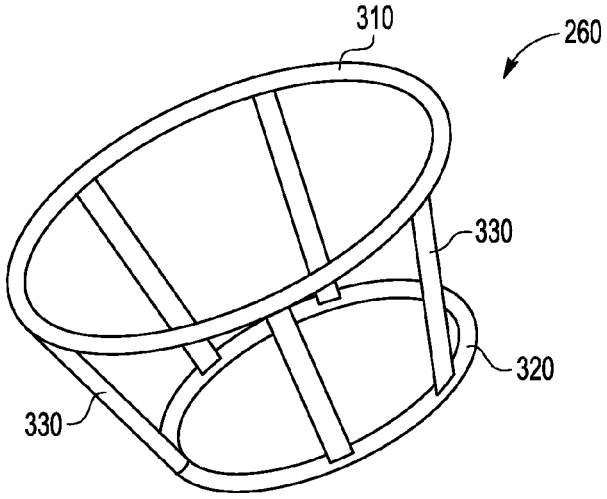
FIG. 3 is a simplified diagram illustrating one example of a support frame, usable by a typical LED fixture.

FIG. 3 is a simplified diagram illustrating one example of a support frame 260, usable by a typical LED fixture. As illustrated, support frame 260 includes an upper ring 310 on which optics 270 can be mounted. Support ring 310 can be shaped in a manner appropriate to mounting and holding optics 270. Support frame 260 also includes a lower ring 320, which is mounted to heat sink 110 at the base of cavity 140. Further, support frame 260 includes a plurality of support struts 330 connecting upper ring 310 with lower ring 320. Support struts 330 are of a length appropriate to extending the upper ring to a point at or near the upper face of heat sink 110, as illustrated in FIG. 2. The shape of support frame 260 is dictated by the application of the LED fixture (e.g., where the optics should be placed for the application), and the dimensions of heat sink cavity 140.

In order to avoid the shielding effects of the heat sink and other metallic elements of the fixture, embodiments of the present invention incorporate a longer antenna that extends from control board 210 to a point external to heat sink 110. In one embodiment, the antenna takes the form of an odd-multiple half-wavelength dipole antenna that is coupled to the circuitry on control board 210 by means of antenna matching circuitry. The length of the antenna is suggested by at least two criteria: the wavelength of RF control signals being used and the distance to be traversed in order to have all or part of the antenna in a location external to the LED fixture heat sink. For example, for an application having control signals transmitted using a frequency of 2.4 GHz, a $\lambda/2$ dipole antenna will have a total length of approximately 2.5 inches, while a $3\lambda/2$ dipole antenna will have a total length of approximately 7.5 inches, and so on. Such dipole antenna lengths are calculated by known methods relating the frequency to the antenna length. The odd multiple of the half-wavelength that is chosen is suggested by the traverse distance to the face of the heat sink and the length to be exposed along the face of the heat sink.

Figure 4:
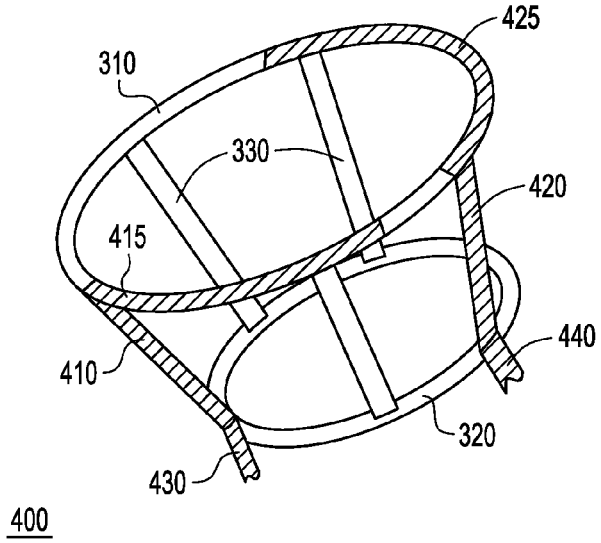
FIG. 4 is a simplified diagram illustrating a modified support frame that includes elements of an antenna, in accord with embodiments of the present invention.

FIG. 4 is a simplified diagram illustrating a modified support frame 400 that includes elements of an odd-multiple half-wavelength dipole antenna, in accord with embodiments of the present invention. In the embodiment illustrated in FIG. 4, the path of the antenna to the face of the heat sink is along modified support frame 400. Modified support frame 400 includes an upper ring 310, lower ring 320, and one or more support struts 330, as described above with regard to support frame 260 in FIG. 3. In addition, modified support frame 400 includes a strut portion 410 of a first antenna segment of the dipole antenna. Strut portion 410 extends between upper ring 310 and lower ring 320, and includes a conductive material appropriate for an antenna application (e.g., copper, aluminum, and the like). In one embodiment, the conductive material is adhesively applied to the exterior of a non-conducting support strut 330. In another embodiment, the support strut is made from the conductive material. The strut portion of the first antenna segment of the dipole antenna is coupled to a ring portion 415 of the first antenna segment. As with the strut portion, ring portion 415 includes a conductive material appropriate for the antenna application and can be either adhesively applied to the exterior of a non-conducting upper ring 310 or ring portion 415 of upper ring 310 can be formed from the conductive material. Similarly, a strut portion 420 of a second antenna segment, and a ring portion 425 of the second antenna segment are provided, and can be formed in the same manner as described for the portions of the first antenna segment. The antenna portions of upper ring 310 are separated by non-conducting, non-antenna portions of the upper ring.

The total length of strut portion 410 plus ring portion 415, along with a connector portion 430 of the first antenna segment that connects the first antenna segment to control board 210, is equal to one half the total length of the dipole antenna. Similarly, the total length of strut portion for 415 plus ring portion 425, along with a connector portion 440 of the second antenna segment that connects the second antenna segment to control board 210, is equal to one half the total length of the dipole antenna. Thus, a dipole antenna length can be chosen such that the length of the ring portions (415 and 425) are maximized on upper ring 310, without the two ring portions coming into contact. In this manner, a maximum unshielded antenna length along the face of the heat sink is provided.

Figure 5:
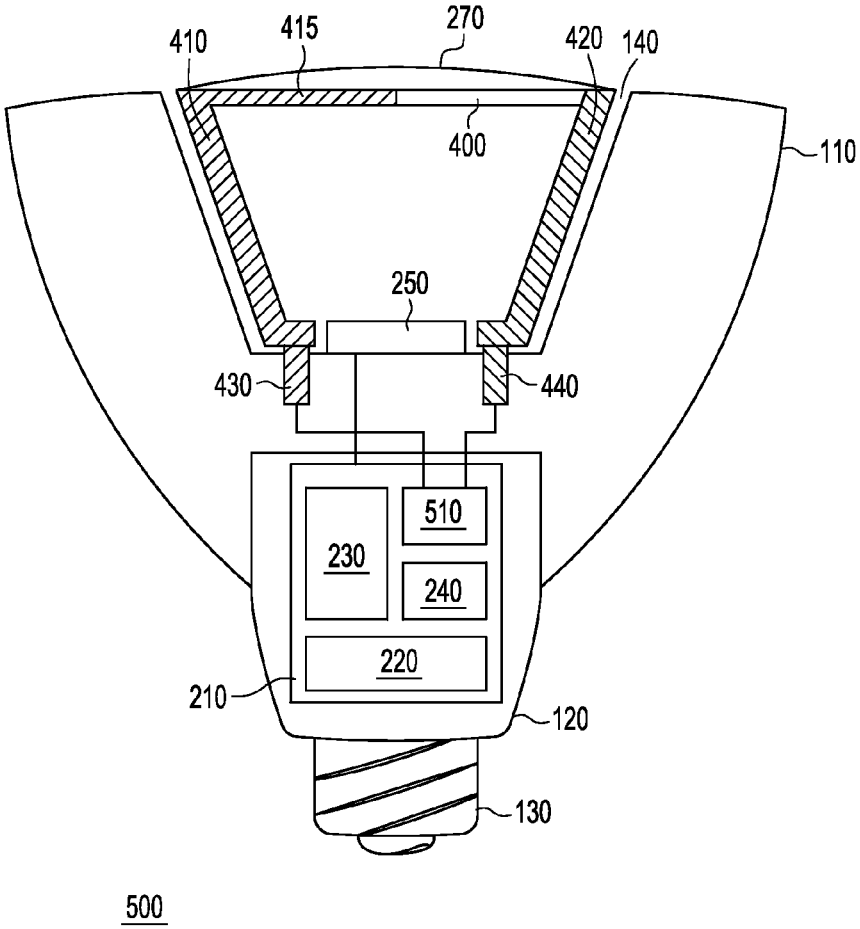
FIG. 5 is a simplified diagram illustrating a cross-section of an LED fixture 500 that incorporates the modified support frame, in accord with embodiments of the present invention.

FIG. 5 is a simplified diagram illustrating a cross-section of an LED fixture 500 that incorporates the modified support frame 400 in accord with embodiments of the present invention. FIG. 5 incorporates many of the same elements previously described with regard to FIG. 2, and the description of those elements will not be repeated for FIG. 5. In addition, FIG. 5 incorporates modified support structure 400 in place of support frame 260.

FIG. 5 illustrates modified support frame 400 as having strut portion 410 of the first antenna segment and ring portion 415 of the first antenna segment. Strut portion 410 is coupled via connector portion of 430 of the first antenna segment to antenna matching circuitry 510 that is incorporated onto control board 210. FIG. 5 also illustrates strut portion 420 of the second antenna segment, which is coupled to ring portion 425 (not shown) of the second antenna segment. Strut portion 420 is coupled via a connector portion 440 of the second antenna segment to antenna matching circuitry 510.

Antenna matching circuitry 510 is configured to match the characteristics of the chosen antenna (e.g., as formed by the first and second antenna segments) to transceiver circuitry incorporated onto control board 210 (e.g., as part of processor 240 or by separate module [not shown]).

Figure 6:
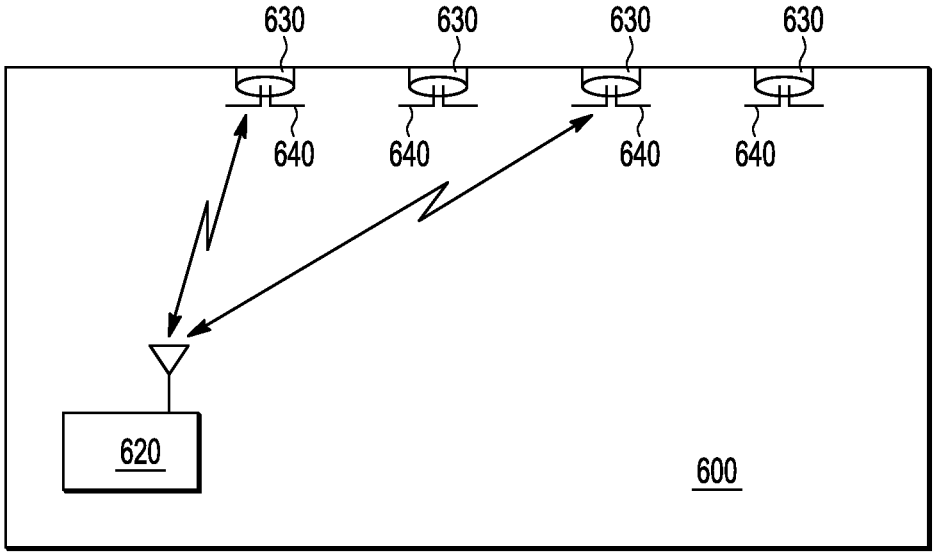
FIG. 6 is a simplified block diagram illustrating a system that includes LED fixtures embodying elements of the present invention.

FIG. 6 is a simplified block diagram illustrating a system that includes LED fixtures embodying elements of the present invention. A premises 610 includes an RF transmitter 620. RF controller 620 can include a variety of controllers for the LED fixtures, including, but not limited to, a home automation hub, an RF wall outlet, and a remote control device. RF controller 620 can generally include a processor configured to interpret any entered control input and to convert that control input to data to be transmitted by a transceiver coupled to an antenna in the form of RF control signals. The RF controller can use a variety of data protocols, for example those defined by IEEE 802.15.4, Z-Wave, and Bluetooth. These data protocols typically use transmission frequencies at or about 900 MHz, 2.4 GHz, and 5.8 GHz.

RF controller 620 can be used to provide RF control signals to one or more LED fixtures 630 that include antenna structures 640 configured as described above. The LED fixtures can be in the same room or different room of premises 610, as long as the LED fixtures are within RF range of the RF controller. LED fixtures 630 can be configured to not only receive and act upon the RF control signals, but also to provide a return transmission (e.g., acknowledgement or status communication) to RF controller 620. RF controller 620 can be configured to receive the return transmissions and act upon those return transmissions accordingly (e.g., provide a status output on a display, execute a next step in a sequential program, and the like).

Embodiments of the present invention are not limited to the configuration illustrated in FIG. 6. For example, there can be more than one RF controller 620 that provides control signals to the LED fixtures (e.g., a Zigbee coordinator and one or more Zigbee routers). There can be a heterogeneous assembly of LED fixtures to control, each being provided control signals corresponding to the capabilities of the LED fixture. Further, the premises can be of multiple rooms and multiple levels.

Embodiments of the present invention take advantage of the physical dimensions of the chosen dipole antenna. Normally, small surface mount chip antennas or inverted-F antennas are used for low-power radio systems because of their small size. But the larger dipole antennas allow for a signal receiving and transmitting mechanism to be extended beyond the shielding effects of the heat sinks used in LED lighting applications, as described above. Further, the size and length of the dipole antenna segments are chosen specifically to integrate into the physical structure of the LED fixture, thereby enabling optimum radio performance and wireless control of the LED fixture.

By now it should be appreciated that there has been provided a light emitting diode fixture that includes a heat sink with a front face and a cavity region, a light emitting diode (LED) mounted on a bottom surface of the cavity region, an antenna disposed at or near the front face of the heat sink and configured to receive RF control signals for the LED, and a controller board coupled to the LED and the antenna that is configured to control the LED in response to the RF control signals, where the controller board is located in a RF-shielded location.

In one aspect of the above embodiment, the LED fixture further includes a support frame mounted in the cavity region of the heat sink. The support frame extends from a mounting point in the cavity region to the face of the heat sink and includes at least a part of the antenna. In a further aspect, the support frame includes a non-conducting material and the portion of the antenna is attached to portions of the support frame. In still a further aspect, the portion of the antenna is adhesively attached to the corresponding portions of the support frame. In another aspect, the support frame includes conducting and a non-conducting materials, and the part of the support frame that includes conducting material includes the portion of the antenna. In a further aspect, the conducting material is one or more of copper and aluminum. In another aspect, the antenna is an odd-multiple half-wavelength dipole antenna, which is selected to maximize a length of each pole of the dipole antenna that is exposed at or near the face of the heat sink on the support frame.

In another aspect of the above embodiment, the LED fixture also includes a transceiver, coupled to the control board and the antenna, which is configured to receive the RF control signals and transmit other RF signals using the antenna. In a further aspect, the RF control signals include a protocol signal from one of IEEE 802.15.4, Z-Wave, and Bluetooth.

Another embodiment provides a system that includes a RF control signal transmitter that provides RF control signals at a selected frequency, a LED fixture configured to receive the RF control signals. The LED fixture includes a heat sink having a front face and body, an LED control board disposed within the heat sink body, and an antenna coupled to the LED control board and having a portion disposed at or near the front face of the heat sink. The antenna is configured to resonate at the selected frequency, and the LED control board receives the RF control signals via the antenna.

One aspect of the above embodiment further includes a LED mounted on a surface of the cavity region of the heat sink, where the cavity region has an opening at the front face of the heat sink and the LED is electrically coupled to the LED control board. In a further aspect, the LED fixture further includes a support frame mounted in the cavity region, which extends from a mounting point in the cavity region to the face of the heat sink and the support frame includes at least a portion of the antenna. In another further aspect, the LED control board provides LED control signals to the LED in response to the received RF control signals.

Another aspect of the above embodiment further includes a plurality of LED fixtures, where the plurality of LED fixtures includes the LED fixture, and each LED fixture of the plurality of LED fixtures is responsive to a corresponding subset of the RF control signals. Another aspect of the above embodiment further includes a plurality of RF control signal transmitters, where the plurality of RF control signal transmitters includes the RF control signal transmitter.

The conductors as discussed herein may be illustrated or described in reference to being a single conductor, a plurality of conductors, unidirectional conductors, or bidirectional conductors. However, different embodiments may vary the implementation of the conductors. For example, separate unidirectional conductors may be used rather than bidirectional conductors and vice versa. Also, plurality of conductors may be replaced with a single conductor that transfers multiple signals serially or in a time multiplexed manner. Likewise, single conductors carrying multiple signals may be separated out into various different conductors carrying subsets of these signals. Therefore, many options exist for transferring signals.

Because the apparatus implementing the present invention is, for the most part, composed of electronic components and circuits known to those skilled in the art, circuit details will not be explained in any greater extent than that considered necessary as illustrated above, for the understanding and appreciation of the underlying concepts of the present invention and in order not to obfuscate or distract from the teachings of the present invention.

Moreover, the terms "front," "back," "top," "bottom," "over," "under" and the like in the description and in the claims, if any, are used for descriptive purposes and not necessarily for describing permanent relative positions. It is understood that the terms so used are interchangeable under appropriate circumstances such that the embodiments of the invention described herein are, for example, capable of operation in other orientations than those illustrated or otherwise described herein.

Also for example, in one embodiment, some of the illustrated elements of LED fixtures 200 and 500 are located on a single control board. Alternatively, LED fixtures 200 and 500 may include any number of separate boards or integrated circuits or separate devices interconnected with each other.

Furthermore, those skilled in the art will recognize that boundaries between the functionality of the above described operations merely illustrative. The functionality of multiple operations may be combined into a single operation, and/or the functionality of a single operation may be distributed in additional operations. Moreover, alternative embodiments may include multiple instances of a particular operation, and the order of operations may be altered in various other embodiments.

Although the invention is described herein with reference to specific embodiments, various modifications and changes can be made without departing from the scope of the present invention as set forth in the claims below. For example, the LED fixtures illustrated are for flood light applications. Embodiments of the present invention equally apply to other lighting applications, such as accent lights, spot lights, and the like. Accordingly, the specification and figures are to be regarded in an illustrative rather than a restrictive sense, and all such modifications are intended to be included within the scope of the present invention. Any benefits, advantages, or solutions to problems that are described herein with regard to specific embodiments are not intended to be construed as a critical, required, or essential feature or element of any or all the claims.

The term "coupled," as used herein, is not intended to be limited to a direct coupling or a mechanical coupling.

Furthermore, the terms "a" or "an," as used herein, are defined as one or more than one. Also, the use of introductory phrases such as "at least one" and "one or more" in the claims should not be construed to imply that the introduction of another claim element by the indefinite articles "a" or "an" limits any particular claim containing such introduced claim element to inventions containing only one such element, even when the same claim includes the introductory phrases "one or more" or "at least one" and indefinite articles such as "a" or "an." The same holds true for the use of definite articles.

Unless stated otherwise, terms such as "first" and "second" are used to arbitrarily distinguish between the elements such terms describe. Thus, these terms are not necessarily intended to indicate temporal or other prioritization of such elements.

What is claimed is:

1. A light emitting diode fixture comprising:
- a heat sink comprising a front face and a cavity region having an opening at the front face of the heat sink and a bottom surface within the heat sink;
- a light-emitting diode (LED) mounted on the bottom surface within the heat sink;
- an antenna disposed at least at or near the front face of the heat sink and configured to receive radio-frequency (RF) control signals for the LED; and
- a controller board coupled to the antenna and the LED and configured to control the LED in response to the RF control signals, wherein the controller board is disposed in a RF-shielded location.

2. The LED fixture of claim 1 further comprising:
- a support frame mounted in the cavity region, wherein
  - the support frame extends from a mounting point in the cavity region to the face of the heat sink, and
  - the support frame comprises at least a portion of the antenna.

3. The LED fixture of claim 2, wherein
- the support frame comprises a non-conducting material, and
- the at least a portion of the antenna is attached to portions of the support frame.

4. The LED fixture of claim 3, wherein
- the at least a portion of the antenna is adhesively attached to corresponding portions of the support frame.

5. The LED fixture of claim 2, wherein
- the support frame comprises in part a non-conducting material and in part a conducting material, and
- the part of the support frame comprising the conducting material comprises the at least a portion of the antenna.

6. The LED fixture of claim 5 wherein the conducting material comprises one or more of copper and aluminum.

7. The LED fixture of claim 2, wherein
- the antenna comprises an odd-multiple half-wavelength dipole antenna, and
- the odd-multiple of a half-wavelength selected for the antenna is selected to maximize a length of each pole of the dipole antenna that is exposed at or near the face of the heat sink on the support frame.

8. The LED fixture of claim 1 further comprising:
- a transceiver, coupled with the control board and the antenna, and configured to receive the RF control signals and to transmit RF signals using the antenna.

9. The LED fixture of claim 8 wherein the RF control signals comprises a protocol signal from one of IEEE 802.15.4, Z-Wave, and Bluetooth.

10. A system comprising:
- a radio-frequency (RF) control signal transmitter configured to provide RF control signals at a selected frequency; and
- a light-emitting diode (LED) fixture configured to receive the RF control signals, the LED fixture comprising
  - a heat sink comprising a front face and a body,
  - an LED control board disposed within the heat sink body, and
  - an antenna, coupled to the LED control board, and having a portion disposed at or near the front face of the heat sink, wherein
    - the antenna is configured to resonate to the selected frequency, and
    - the LED control board receives the RF control signals via the antenna.

11. The system of claim 10 wherein the LED fixture further comprises:
- a light-emitting diode mounted on a surface of a cavity region formed within the heat sink, wherein
  - the cavity region has an opening at the front face of the heat sink, and
  - the light-emitting diode is electrically coupled to the LED control board.

12. The system of claim 11 wherein the LED fixture further comprises:
- a support frame mounted in the cavity region, wherein
  - the support frame extends from a mounting point in the cavity region to the face of the heat sink, and
  - the support frame comprises at least a portion of the antenna.

13. The system of claim 11, wherein the LED control board provides LED control signals to the LED in response to the received RF control signals.

14. The system of claim 10 further comprising:

a plurality of LED fixtures, wherein the plurality of LED fixtures comprises the LED fixture, and each LED fixture of the plurality of LED fixtures is responsive to a corresponding subset of the RF control signals.

15. The system of claim 10 further comprising:

a plurality of RF control signal transmitters, wherein the plurality of RF control signal transmitters comprises the RF control signal transmitter.

* * * * *